US010259220B2

(12) United States Patent
Hamano et al.

(10) Patent No.: US 10,259,220 B2
(45) Date of Patent: Apr. 16, 2019

(54) LIQUID JET HEAD AND LIQUID JET APPARATUS

(71) Applicant: SII Printek Inc., Chiba-shi, Chiba (JP)

(72) Inventors: Yuichiro Hamano, Chiba (JP); Yutaka Hongo, Chiba (JP)

(73) Assignee: SII PRINTEK INC., Chiba (JP)

( * ) Notice: Subject to any disclaimer, the term of this patent is extended or adjusted under 35 U.S.C. 154(b) by 10 days.

(21) Appl. No.: 15/591,458

(22) Filed: May 10, 2017

(65) Prior Publication Data

US 2017/0341387 A1 Nov. 30, 2017

(30) Foreign Application Priority Data

May 27, 2016 (JP) ..... 2016-106238
Dec. 27, 2016 (JP) ..... 2016-252721

(51) Int. Cl.
*B41J 2/14* (2006.01)

(52) U.S. Cl.
CPC .. *B41J 2/14209* (2013.01); *B41J 2002/14362* (2013.01); *B41J 2002/14419* (2013.01); *B41J 2202/08* (2013.01); *B41J 2202/20* (2013.01)

(58) Field of Classification Search
CPC ..... B41J 2/175; B41J 2002/14491; B41J 2202/20; B41J 2/1433; B41J 2002/14362; B41J 2202/19; B41J 2/14; B41J 2/14201; B41J 2/14209; B41J 2/14024; B41J 2002/14419; B41J 2202/16; B41J 2202/08
USPC ..... 347/6, 20, 40, 44, 47, 50, 71, 85
See application file for complete search history.

(56) References Cited

U.S. PATENT DOCUMENTS

2003/0112300 A1* 6/2003 Chung ..... B41J 2/161 347/71
2009/0289986 A1* 11/2009 Laaspere ..... B41J 2/2146 347/20
2013/0187976 A1 7/2013 Kobayashi
2016/0009087 A1 1/2016 Okui et al.

FOREIGN PATENT DOCUMENTS

EP 1 321 294 A2 6/2003
EP 2 133 204 A1 12/2009
JP 2015-120265 A 7/2015

OTHER PUBLICATIONS

Extended Search Report in European Application No. 17173102.9, dated Oct. 24, 2017, 6 pages.

* cited by examiner

*Primary Examiner* — Julian D Huffman
(74) *Attorney, Agent, or Firm* — Brinks Gilson & Lione

(57) ABSTRACT

A liquid jet head includes: a nozzle plate including a nozzle array, the nozzle array including a plurality of nozzle holes each extending in a Z direction, the nozzle holes being arranged side by side in an X direction; a head chip disposed in a +Z direction with respect to the nozzle plate and including ejection channels communicating with the respective nozzle holes; a manifold disposed in a +Y direction with respect to the head chip, the manifold being configured to support the head chip by a face facing a −Y direction and including an ink flow path communicating with the ejection channels; and a drive board supported on the face facing the −Y direction of the manifold and electrically connected to the head chip.

10 Claims, 8 Drawing Sheets

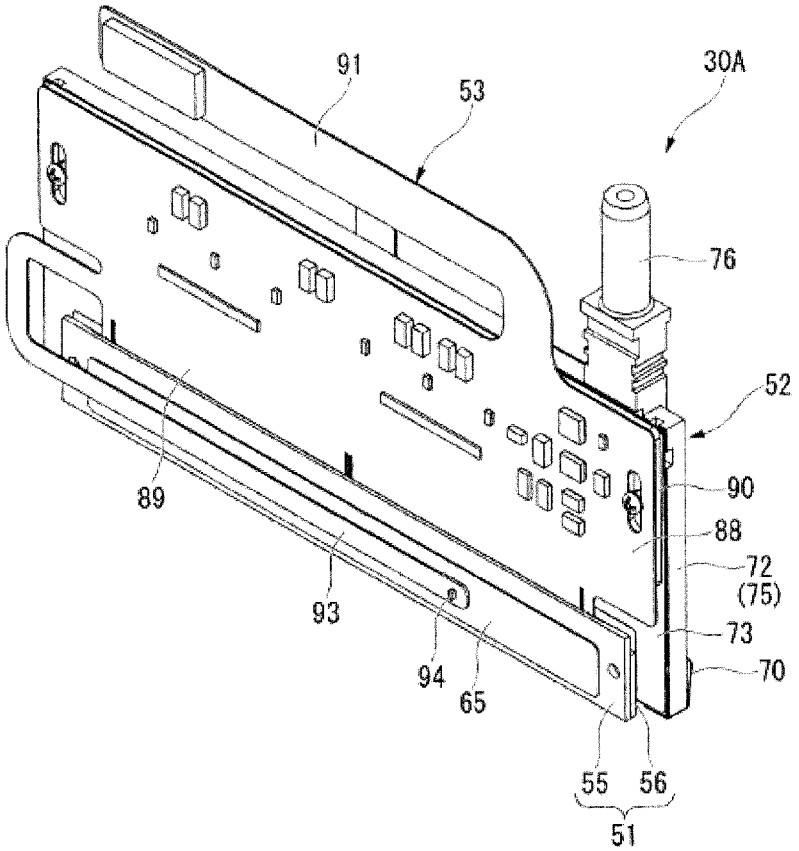
FIG. 4
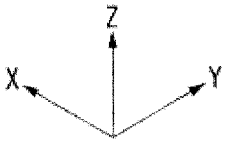

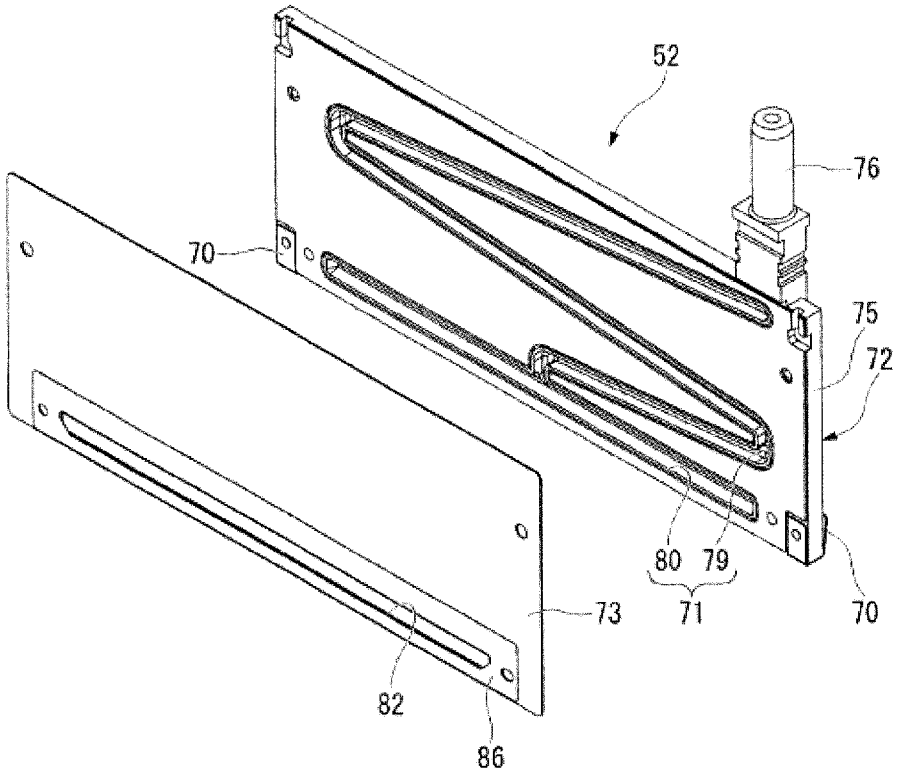
FIG. 6
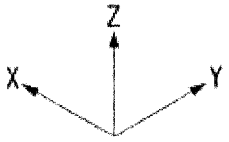

LIQUID JET HEAD AND LIQUID JET APPARATUS

RELATED APPLICATIONS

This application claims priority under 35 U.S.C. § 119 to Japanese Patent Applications No. 2016-106238 filed on May 27, 2016 and No. 2016-252721 filed on Dec. 27, 2016, the entire content of which is hereby incorporated by reference.

BACKGROUND OF THE INVENTION

Technical Field

The present invention relates to a liquid jet head and a liquid jet apparatus.

Related Art

Conventionally, there has been an ink jet printer provided with an ink jet head as an apparatus that ejects ink in the form of liquid droplets onto a recording medium such as recording paper to record images or characters on the recording medium. For example, the ink jet head includes a plurality of head modules corresponding to respective colors which are mounted on a carriage.

The above head module includes a head chip which ejects ink, a manifold which includes an ink flow path for supplying ink to the head chip, and a drive board which drives the head chip (e.g., JP 2015-120265 A). The head chip, the manifold, and the drive board are mounted on a base member.

In JP 2015-120265 A, the base member is provided with a horizontal base which extends in a scanning direction of the ink jet head and a vertical base which stands from the horizontal base.

The head chip and the drive board are supported, for example, on the vertical base. Accordingly, heat generated in the head chip and the drive board is dissipated through the vertical base. On the other hand, the manifold is disposed on the base member at a side opposite to the vertical base across the head chip in the scanning direction of the ink jet head.

SUMMARY OF THE INVENTION

However, in the above conventional technique, the manifold and the drive board (vertical base) are separately disposed at the opposite sides in the scanning direction with respect to the head chip. Thus, there is still room for improvement in downsizing of the ink jet head in the scanning direction.

The present invention has been made in view of the above circumstances, and an object thereof is to provide a liquid jet head and a liquid jet apparatus that enable downsizing in the scanning direction.

In order to solve the above problem, a liquid jet head according to one aspect to the present invention includes: a jet hole plate including a jet hole array, the jet hole array including a plurality of jet holes each extending in a first direction, the jet holes being arranged side by side in a second direction perpendicular to the first direction; a head chip disposed at one side in the first direction with respect to the jet hole plate and including channels communicating with the respective jet holes; a manifold disposed at one side in a third direction perpendicular to the first direction and the second direction with respect to the head chip, the manifold being configured to support the head chip by a first face facing the third direction and including a liquid flow path communicating with the channels; and a drive board supported on the first face of the manifold and electrically connected to the head chip.

According to this configuration, the head chip and the drive board are supported on the manifold which includes the liquid flow path. Thus, it is possible to downsize the liquid jet head in the third direction as compared to a conventional configuration in which a member which supports the head chip and the drive board is disposed at one side in the third direction with respect to the head chip and a member which includes the liquid flow path is separately disposed at the other side in the third direction with respect to the head chip.

Further, since the head chip and the drive board are supported on the manifold, heat generated in the head chip and the drive board is dissipated to the outside through the manifold. This makes it possible to enhance the heat dissipation performance of the head chip and the drive board.

Further, since the head chip and the drive board are supported on the manifold which includes the liquid flow path, liquid flowing through the liquid flow path can be heated using exhaust heat which is generated in the head chip and the drive board and transmitted to the manifold. As a result, it is possible to supply liquid having a desired temperature (viscosity) to the head chip and thereby obtain an excellent printing characteristic.

In the above aspect, the liquid jet head may further include a damper configured to absorb pressure fluctuations of liquid supplied to the liquid flow path, the damper being disposed at a side opposite to the jet hole plate in the first direction with respect to the manifold and connected to the liquid flow path.

According to the above aspect, the damper is disposed at the side opposite to the jet hole plate in the first direction with respect to the manifold. Thus, it is possible to downsize the liquid jet head in the third direction as compared to a configuration in which the damper and the manifold are disposed side by side in the third direction.

In the above aspect, the head chip, the manifold, and the drive board may constitute a head module, and a plurality of the head modules may be mounted side by side in the third direction on a base member.

According to the above aspect, even when a plurality of head modules are mounted, it is possible to provide a small liquid jet head.

In the above aspect, the jet hole plate may include a plurality of the jet hole arrays corresponding to the head chips of the head modules, and may be disposed on a plate placement face of the base member, the plate placement face facing the other side in the first direction.

According to the above aspect, since the jet hole plate which includes the jet hole arrays corresponding to the respective head modules is disposed on the plate placement face of the base member, it is possible to improve the position accuracy of the jet holes as compared to a configuration in which the jet hole plate is attached to each of the head modules.

In the above aspect, the liquid jet head may further include a spacer interposed between the plate placement face of the base member and a face of the jet hole plate, the face facing the plate placement face of the base member in the first direction.

According to the above aspect, since the spacer is interposed between the jet hole plate and the base member, it is possible to relax a stress that acts on the jet hole plate and the base member due to a difference in thermal expansion coefficient between the jet hole plate and the base member. As a result, it is possible to reduce come-off of the jet hole plate from the head chip.

In the above aspect, the spacer may be adhered to the base member with a soft adhesive, and the jet hole plate may be adhered to the spacer with a hard adhesive formed of a material harder than the soft adhesive.

According to the above aspect, it is possible to reliably relax a stress that acts on the spacer and the base member due to a difference in thermal expansion coefficient between the spacer and the base member. As a result, it is possible to reduce come-off of the jet hole plate from the head chip.

In the above aspect, the base member may include an attachment opening that penetrates the base member in the first direction and inserts the head module therein, and the liquid jet head may further include a biasing member configured to bias the head module and the base member in at least either the second direction or the third direction, the biasing member being interposed between the head module and the base member.

According to the above aspect, since the biasing member biases the head module and the base member in at least either the second direction or the third direction, it is possible to position the head module with respect to the base member with high accuracy and thereby improve assemblability.

In the above aspect, the manifold may include a first flow path plate and a second flow path plate that are stacked in the third direction, and the liquid flow path may be defined between the first flow path plate and the second flow path plate.

According to the above aspect, since the first flow path plate and the second flow path plate are stacked to form the manifold, it is possible to easily form the liquid flow path on the manifold as compared to a configuration in which the manifold is integrally formed.

In the above aspect, the first flow path plate may be formed of a material having a higher thermal conductivity than the second flow path plate and thicker than the second flow path plate in the third direction, and a face facing the other side in the third direction of the second flow path plate may constitute the first face that supports the head chip and the drive board.

According to the above aspect, since the head chip and the drive board are supported on the second flow path plate, the first flow path plate can be formed of a material having a high thermal conductivity regardless of proof stress for supporting the head chip and the drive board. In this case, since the second flow path plate is thinner than the first flow path plate, heat generated in the head chip and the drive board is easily transmitted to the first flow path plate through the second flow path plate. As a result, the heat generated in the head chip and the drive board is effectively dissipated to the outside through the manifold, which enhances the heat dissipation performance of the head chip and the drive board.

A liquid jet apparatus according to one aspect of the present invention includes the liquid jet head according to the above aspect.

According to the above aspect, it is possible to provide the liquid jet apparatus having high reliability while achieving downsizing in the third direction.

According to one aspect of the present invention, it is possible to provide the liquid jet head and the liquid jet apparatus having high reliability while achieving downsizing in the third direction and enhancing the heat dissipation performance.

BRIEF DESCRIPTION OF THE DRAWINGS

FIG. 4 is a perspective view of a first head module according to the embodiment;

FIG. 6 is an exploded perspective view of a manifold according to the embodiment;

DETAILED DESCRIPTION OF THE PREFERRED EMBODIMENTS

Figure 1:
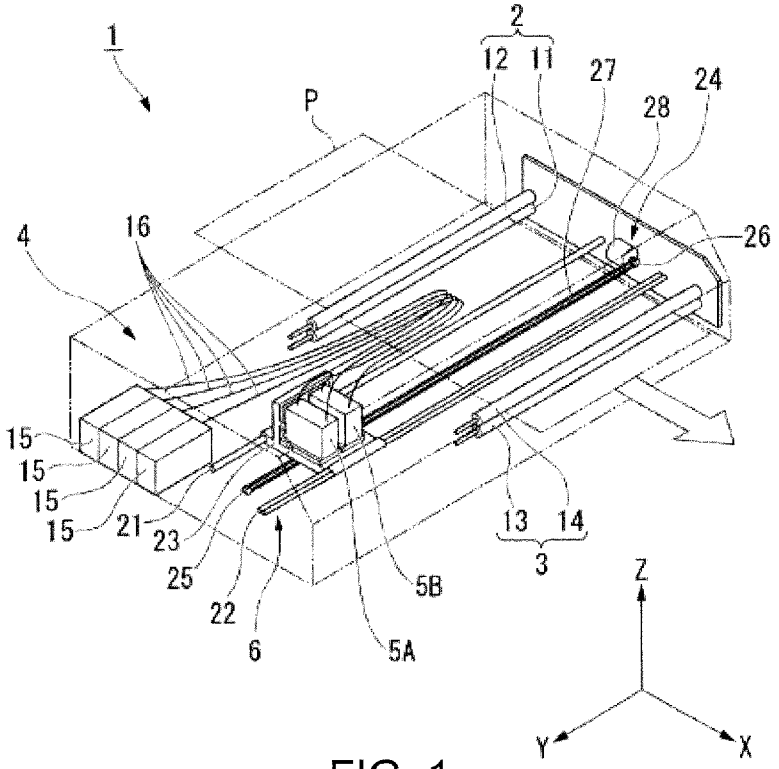
FIG. 1 is a schematic configuration diagram of an ink jet printer according to an embodiment.

Hereinbelow, an embodiment according to the present invention will be described with reference to the drawings. In the following description, an ink jet printer (hereinbelow, merely referred to as the printer) which performs recording on a recording medium using ink (liquid) will be described as an example. Note that, in the drawings used in the following description, the scale of each member is appropriately changed so as to allow each member to have a recognizable size.

[Printer]

FIG. 1 is a schematic configuration diagram of a printer 1.

As illustrated in FIG. 1, the printer 1 of the present embodiment is provided with a pair of conveyance mechanisms 2, 3, an ink supply mechanism 4, ink jet heads 5A, 5B, and a scanning mechanism 6. In the following description, an X, Y, Z orthogonal coordinate system is used as needed. In this case, an X direction (second direction) corresponds to a conveyance direction (sub-scanning direction) of a recording medium P (e.g., paper). A Y direction (third direction) corresponds to a scanning direction (main-scanning direction) of the scanning mechanism 6. A Z direction (first direction) indicates a height direction which is perpendicular to the X direction and the Y direction. In the following description, in the X direction, the Y direction, and the Z direction, an arrow direction in the drawings is defined as a plus (+) direction, and a direction opposite to the arrow is defined as a minus (−) direction.

The conveyance mechanisms 2, 3 convey the recording medium P in the +X direction. Specifically, the conveyance mechanism 2 is provided with a grid roller 11 which extends in the Y direction, a pinch roller 12 which extends parallel to the grid roller 11, and a drive mechanism (not illustrated) such as a motor which axially rotates the grid roller 11. Similarly, the conveyance mechanism 3 is provided with a grid roller 13 which extends in the Y direction, a pinch roller 14 which extends parallel to the grid roller 13, and a drive mechanism (not illustrated) which axially rotates the grid roller 13.

The ink supply mechanism 4 is provided with an ink tank 15 which stores ink therein and an ink tube 16 which connects the ink tank 15 to the ink jet heads 5A, 5B.

In the present embodiment, a plurality of ink tanks 15 are arranged side by side in the X direction. The ink tanks 15 store therein respective four colors of ink, for example, yellow ink, magenta ink, cyan ink, and black ink.

The ink tube 16 is, for example, a flexible hose which has flexibility. The ink tube 16 connects each of the ink tanks 15 to a corresponding one of the ink jet heads 5A, 5B.

The scanning mechanism 6 moves the ink jet heads 5A, 5B back and forth in the Y direction. Specifically, the scanning mechanism 6 is provided with a pair of guide rails 21, 22 which extend in the Y direction, a carriage 23 which is movably supported on the pair of guide rails 21, 22, and a drive mechanism 24 which moves the carriage 23 in the Y direction.

The drive mechanism 24 is disposed between the guide rails 21, 22 in the X direction. The drive mechanism 24 is provided with a pair of pulleys 25, 26 which are disposed at an interval in the Y direction, an endless belt 27 which is wound around the pair of pulleys 25, 26, and a drive motor 28 which drives the pulley 25 to rotate.

The carriage 23 is coupled to the endless belt 27. The ink jet heads 5A, 5B are mounted on the carriage 23 side by side in the Y direction. Each of the ink jet heads 5A, 5B is configured to eject two colors of ink. Thus, in the printer 1 of the present embodiment, the ink jet head 5A ejects two colors of ink different from two colors of ink ejected by the ink jet head 5B, so that four colors of ink: yellow ink, magenta ink, cyan ink, and black ink can be ejected.

<Ink Jet Head>

Figure 2:
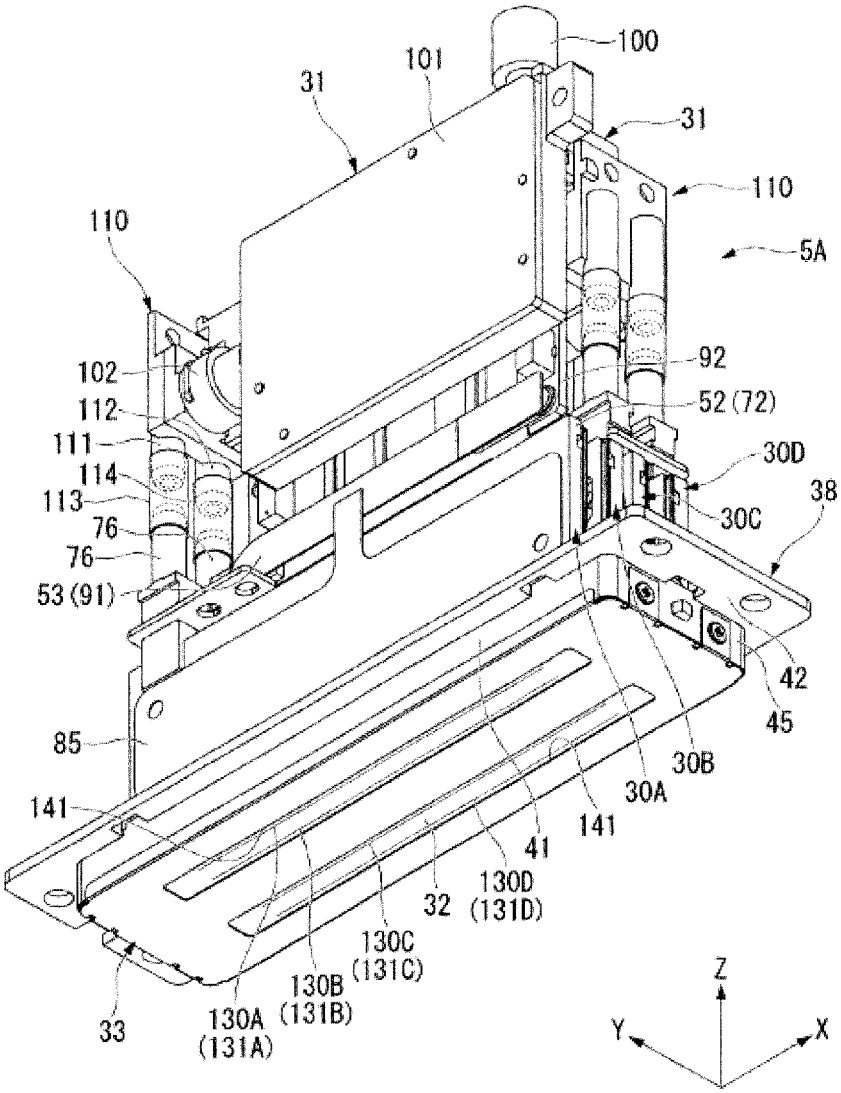
FIG. 2 is a perspective view of the ink jet head according to the embodiment.

FIG. 2 is a perspective view of the ink jet head 5A. The ink jet heads 5A, 5B have the same configuration except the colors of ink supplied thereto. Thus, hereinbelow, the ink jet head 5A will be described, and description for the ink jet head 5B will be omitted.

As illustrated in FIG. 2, the ink jet head 5A of the present embodiment includes head modules 30A to 30D, a damper 31, a nozzle plate (jet hole plate) 32, and a nozzle guard (jet hole guard) 33 all of which are mounted on a base member 38. In FIG. 2, a cover which covers the head modules 30A to 30D and the damper 31 is not illustrated.

(Base Member)

Figure 3:
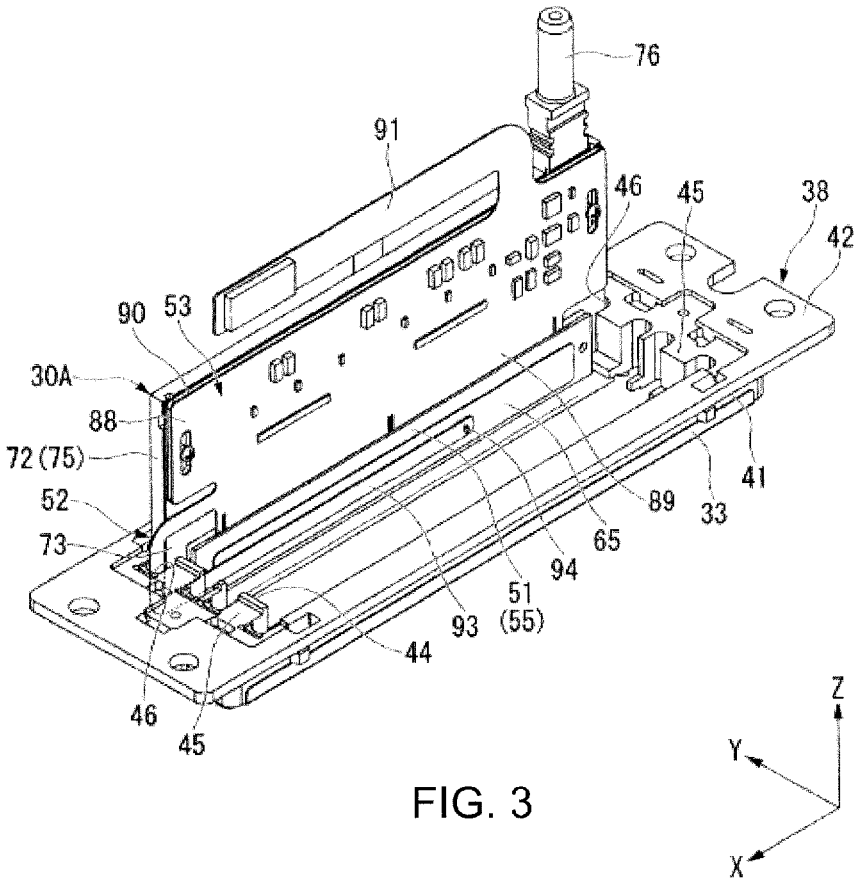
FIG. 3 is a perspective view illustrating a state in which a part of the ink jet head according to the embodiment is detached.

FIG. 3 is a perspective view illustrating a state in which a part of the ink jet head 5A is detached.

As illustrated in FIG. 3, the base member 38 is formed in a plate-like shape whose thickness direction corresponds to the Z direction and whose longitudinal direction corresponds to the X direction. The base member 38 includes a module holding portion 41 which holds each of the head modules 30A to 30D and a carriage fixing portion 42 for fixing the base member 38 to the carriage 23 (refer to FIG. 1). In the present embodiment, the base member 38 is integrally formed of a metal material.

The module holding portion 41 is formed in a frame shape in plan view viewed from the Z direction. That is, an attachment opening 44 which penetrates the base member 38 in the Z direction is formed on a central part of the module holding portion 41 in an XY plane. The module holding portion 41 includes a pair of short side parts 45 which are located at opposite sides in the X direction and include insertion grooves 46. In the present embodiment, insertion grooves 46 that are formed on the respective short side parts 45 and opposed to each other in the X direction are defined as one set, and a plurality of sets (e.g., four sets) of insertion grooves 46 are formed at intervals in the Y direction.

Each of the insertion grooves 46 is recessed in the X direction with respect to the inner peripheral face of the short side part 45 and penetrates the short side part 45 in the Z direction. That is, the insertion grooves 46 communicate with the attachment opening 44. Each of the head modules 30A to 30D is insertable into a corresponding set of insertion grooves 46 which are opposed to each other in the X direction. In each set of insertion grooves 46, a first biasing member (not illustrated) is disposed on an inner face of one of the insertion grooves 46. The first biasing member biases a corresponding one of the head modules 30A to 30D to one side in the X direction toward the other insertion groove 46. In the present embodiment, the first biasing member is formed in a flat spring shape.

The carriage fixing portion 42 projects on the XY plane from a +Z direction end of the module holding portion 41. The carriage fixing portion 42 includes an attachment hole for attaching the base member 38 to the carriage 23 (refer to FIG. 1).

(Head Module)

As illustrated in FIG. 2, each of the head modules 30A to 30D is capable of ejecting ink supplied from the ink tank 15 (refer to FIG. 1) toward the recording medium P. The head modules 30A to 30D are mounted on the base member 38 at intervals in the Y direction. In the present embodiment, four head modules including the first head module 30A, the second head module 30B, the third head module 30C, and the fourth head module 30D are mounted on the base member 38.

In the ink jet head 5A of the present embodiment, each two of the four head modules 30A to 30D eject one color of ink. Specifically, the first head module 30A and the second head module 30B are configured to eject the same color of ink, and the third head module 30C and the fourth head module 30D are configured to eject the same color of ink. Note that the number of head modules 30A to 30D mounted on the base member 38 and the types of ink ejected from the head modules 30A to 30D can be appropriately changed. The head modules 30A to 30D have corresponding configurations to each other. Thus, hereinbelow, the first head module 30A will be described as an example.

FIG. 4 is a perspective view of the first head module 30A.

As illustrated in FIG. 4, the first head module 30A is mainly provided with a head chip 51, a manifold 52, and a drive board 53.

(Head Chip)

Figure 5:
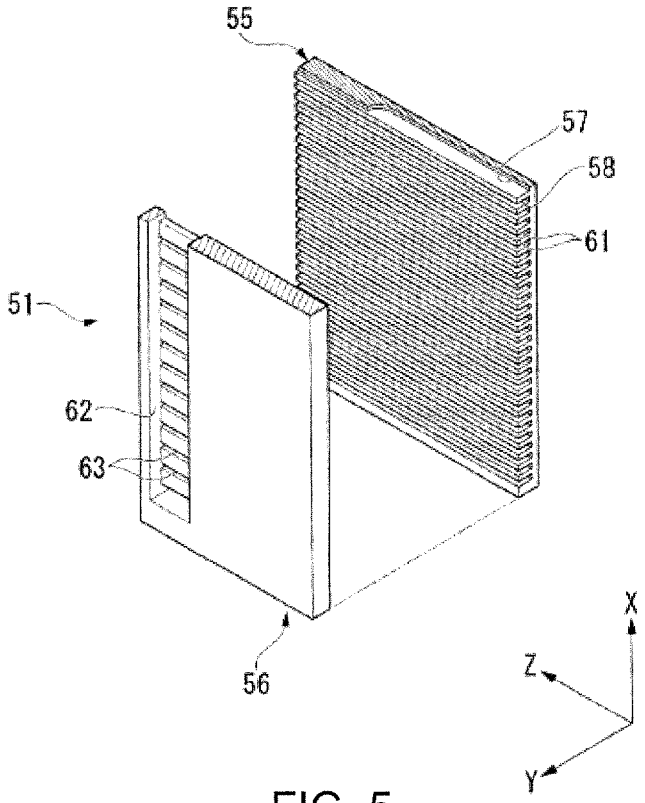
FIG. 5 is an exploded perspective view of a head chip according to the embodiment.

FIG. 5 is an exploded perspective view of the head chip 51.

As illustrated in FIG. 5, the head chip 51 is an edge shoot type head chip which ejects ink from an end in an extending direction (Z direction) of an ejection channel 57 (described below). Specifically, the head chip 51 includes an actuator plate 55 and a cover plate 56 which are stacked in the Y direction.

The actuator plate 55 is a monopole substrate whose polarization direction is set at one direction along the thickness direction (Y direction). For example, a ceramic substrate which is made of lead zirconate titanate (PZT) is suitably used as the actuator plate 55. The actuator plate 55 may be formed by laminating two piezoelectric substrates whose polarization directions differ from each other in the Y direction (chevron type).

The actuator plate 55 includes a plurality of channels 57, 58 which are formed on a face facing the +Y direction (hereinbelow, referred to as the "front face") and arranged side by side at intervals in the X direction. Each of the channels 57, 58 is linearly formed along the Z direction. Each of the channels 57, 58 is open on a −Z direction end face of the actuator plate 55 and ends on a +Z direction end face of the actuator plate 55. Each of the channels 57, 58 may be inclined with respect to the Z direction.

The channels 57, 58 are classified into the ejection channels 57 which are filled with ink and the non-ejection channels 58 which are not filled with ink. The ejection channels 57 and the non-ejection channels 58 are alternately arranged side by side in the X direction. The channels 57, 58 are partitioned by drive walls 61 of the actuator plate 55 in the X direction. Drive electrodes (not illustrated) are formed on inner faces of the channels 57, 58.

The cover plate 56 is formed in a rectangular shape in front view viewed from the Y direction. The cover plate 56 is joined to the front face of the actuator plate 55 with the +Z direction end of the actuator plate 55 projecting therefrom.

The cover plate 56 includes a common ink chamber 62 which is formed on a face facing the +Y direction (hereinbelow, referred to as the "front face") and a plurality of slits 63 which are formed on a face facing the −Y direction (hereinbelow, referred to as the "back face").

The common ink chamber 62 is formed at a position corresponding to a +Z direction end of each of the ejection channels 57 in the Z direction. The common ink chamber 62 is recessed from the front face of the cover plate 56 toward the −Y direction and extends in the X direction. Ink flows into the common ink chamber 62 through the manifold 52.

The slits 63 are formed in the common ink chamber 62 at positions facing the respective ejection channels 57 in the Y direction. The slits 63 allow the common ink chamber 62 and the respective ejection channels 57 to communicate with each other. On the other hand, the non-ejection channels 58 do not communicate with the common ink chamber 62.

As illustrated in FIG. 4, a heat transfer plate 65 is attached to a face facing the −Y direction (hereinbelow, referred to as the "back face") of the actuator plate 55. The heat transfer plate 65 is formed of a material having a high thermal conductivity (e.g., aluminum). The heat transfer plate 65 covers the entire channels 57, 58 on the back face of the actuator plate 55. The size and the position of the heat transfer plate 65 can be appropriately changed.

(Manifold)

The manifold 52 includes an ink flow path 71 (refer to FIG. 6) through which ink flows toward the head chip 51. The manifold 52 is formed in a plate-like shape whose thickness direction corresponds to the Y direction as a whole. The manifold 52 is inserted into one set of insertion grooves 46 which are opposed to each other in the X direction so as to be held in a standing state in the +Z direction on the base member 38. As illustrated in FIG. 4, second biasing members 70 are disposed on opposite ends in the X direction at a −Z direction end of the manifold 52. Each of the second biasing members 70 is interposed between the inner face of the insertion groove 46 and the manifold 52 inside the insertion groove 46 to bias the first head module 30A in the −Y direction. In the present embodiment, the second biasing member 70 is formed in a flat spring shape.

FIG. 6 is an exploded perspective view of the manifold 52.

As illustrated in FIG. 6, the manifold 52 includes a flow path member 72 and a flow path cover 73 which is stacked on the flow path member 72 in the Y direction.

The flow path member 72 is integrally formed of a material having a high thermal conductivity. In the present embodiment, a metal material (e.g., aluminum) is suitably used as the material of the flow path member 72.

The flow path member 72 is provided with a flow path plate 75 and an inflow port 76.

The flow path plate 75 is formed in a rectangular plate-like shape whose thickness direction corresponds to the Y direction. The flow path plate 75 includes the ink flow path 71 which is formed on a face facing the −Y direction. The ink flow path 71 is formed in a groove shape recessed in the +Y direction. Specifically, the ink flow path 71 includes a meandering portion 79 and a communication portion 80.

The meandering portion 79 extends in the Z direction while meandering in the X direction. A +Z direction end of the meandering portion 79 communicates with the inside of the inflow port 76. On the other hand, a −Z direction end of the meandering portion 79 communicates with the communication portion 80 at a central part in the X direction of the flow path plate 75. A meandering direction of the meandering portion 79 can be appropriately changed to any direction that makes the meandering portion 79 longer than a straight line connecting a communicating part between the meandering portion 79 and the inflow port 76 to a communicating part between the meandering portion 79 and the communication portion 80. For example, the meandering portion 79 may extend in the X direction while meandering in the Z direction.

The communication portion 80 extends in the X direction at a −Z direction end of the flow path plate 75. The communication portion 80 has the same shape as the common ink chamber 62 in front view viewed from the Y direction.

In the first head module 30A, the inflow port 76 is disposed at a −X direction end on a +Z direction end face of the flow path plate 75. The inflow port 76 is formed in a tubular shape projecting toward the +Z direction from the flow path plate 75. A −Z direction end of the inflow port 76 communicates with the meandering portion 79.

The flow path cover 73 is formed in a rectangular plate-like shape which has the same outer shape as the flow path plate 75 in front view viewed from the Y direction and has a Y-direction thickness thinner than the flow path plate 75. The flow path cover 73 is fixed to the face facing the −Y direction of the flow path plate 75 and blocks the ink flow path 71 from the −Y direction. A communication hole 82 which opens the communication portion 80 is formed on the flow path cover 73 at a position overlapping the communication portion 80 in the Y direction. The communication hole 82 has the same shape as the communication portion 80 in front view viewed from the Y direction.

In the present embodiment, the flow path cover 73 is formed of a metal material (e.g., stainless steel) that has a high thermal conductivity and higher proof stress than the flow path member 72. In the present embodiment, the groove-shaped ink flow path 71 is formed only on the flow path member 72. However, the present invention is not limited only to this configuration. It is only required that an ink flow path be formed on at least either the flow path member 72 or the flow path cover 73 to form the ink flow path 71 between the flow path member 72 and the flow path cover 73. In this case, for example, grooves may be formed on both the flow path member 72 and the flow path cover 73, and the grooves of the flow path member 72 and the flow path cover 73 may be joined to form an ink flow path.

In the present embodiment, the flow path member 72 and the flow path cover 73 are stacked to form the manifold 52. However, the present invention is not limited to this configuration. The manifold 52 may be integrally formed.

The flow path cover 73 includes an insulating sheet 86 which is disposed on a face facing the −Y direction. The insulating sheet 86 is formed in a frame shape in front view viewed from the Y direction. The insulating sheet 86 surrounds the periphery of the communication hole 82 on the face facing the −Y direction of the flow path cover 73. The insulating sheet 86 is fixed to the face facing the −Y direction of the flow path cover 73 with, for example, an adhesive. In the present embodiment, for example, polyimide is suitably used as the insulating sheet 86. The material of the insulating sheet 86 can be appropriately changed to any material (e.g., a resin material or a rubber material) that has a characteristic capable of sufficiently reducing stray capacitance (e.g., a material having a low dielectric constant or a material capable of reducing a dielectric constant with a tiny space distance) or an ink resistance (elution resistance) and that is relatively soft (has a small Young's modulus).

As illustrated in FIGS. 4 and 6, the head chip 51 is fixed on the face facing the −Y direction (a first face facing a third direction) of the flow path cover 73 with the insulating sheet 86 interposed therebetween. Specifically, the head chip 51 is fixed to the insulating sheet 86 with, for example, an adhesive with the front face (the face facing the manifold 52) of the cover plate 56 facing the insulating sheet 86. In this case, the common ink chamber 62 of the cover plate 56 communicates with the communication portion 80 through the communication hole 82. Accordingly, ink flowing through the ink flow path 71 is supplied to the head chip 51. The head chip 51 projects in the −Z direction with respect to the manifold 52 when fixed to the manifold 52. In the example illustrated in FIG. 4, the length in the X direction of the head chip 51 is shorter than the length in the X direction of the manifold 52.

As illustrated in FIG. 2, a heater 85 is disposed on a face facing the +Y direction (a second face facing the third direction) of the flow path member 72 (the flow path plate 75). The heater 85 heats the inside of the ink flow path 71 through the flow path member 72 to keep ink flowing through the ink flow path 71 within a predetermined temperature range (keep the ink warm).

As illustrated in FIG. 4, the drive board 53 is a flexible printed circuit board and includes a wiring pattern and various electronic components which are mounted on a base film. The drive board 53 includes a module control portion 88 which is supported on the manifold 52 and a chip connecting portion 89 which connects the module control portion 88 to the head chip 51. In the drive board 53, for example, a rigid board may be used as the module control portion 88 as long as at least the chip connecting portion 89 is composed of a flexible board.

The module control portion 88 is formed in a rectangular shape in front view viewed from the Y direction. An electronic component such as a driver IC is mounted on the module control portion 88. The module control portion 88 is fixed to the manifold 52 with a support plate 90 interposed therebetween in a part located in the +Z direction with respect to the head chip 51 on the face facing the −Y direction of the flow path cover 73. The support plate 90 is formed of a material (e.g., a metal material) having a high thermal conductivity. The support plate 90 may not be provided. That is, the module control portion 88 may be directly fixed to the manifold 52.

As illustrated in FIG. 2, the drive board 53 is electrically connected to an external connection board 92 through a lead-out portion 91 which is led out from the module control portion 88 in the +Z direction. The external connection board 92 relays a control signal and drive voltage output from a main control board (not illustrated) which is mounted on the printer 1 to each of the head modules 30A to 30D (driver IC). The drive board 53 drives the head chip 51 on the basis of the control signal and the drive voltage relayed by the external connection board 92.

As illustrated in FIG. 4, the chip connecting portion 89 extends in the −Z direction from the module control portion 88 with a clearance left in the Y direction with respect to the flow path cover 73. A −Z direction end of the chip connecting portion 89 is fixed to the +Z direction end of the actuator plate 55 by, for example, pressure bonding. Accordingly, the drive board 53 and the drive electrodes of the head chip 51 are electrically connected.

The drive board 53 is provided with a sensor connecting portion 93 which is led out from a +X direction end of the module control portion 88. The sensor connecting portion 93 extends up to a position that overlaps the heat transfer plate 65 when viewed from the Y direction. A temperature sensor 94 (e.g., a thermistor) which detects an ink temperature inside the ejection channels 57 is mounted on the tip of the sensor connecting portion 93. The temperature sensor 94 is disposed on the back face of the actuator plate 55 with the heat transfer plate 65 interposed therebetween.

As illustrated in FIG. 3, the first head module 30A is inserted in the attachment opening 44 with the manifold 52 inserted in the corresponding set of insertion grooves 46 as described above. In this case, the first head module 30A is held on the base member 38 in such a manner that the head chip 51 faces the −Y direction and a −Z direction end face of the head chip 51 is flush with a −Z direction end face of the base member 38 (the module holding portion 41).

As illustrated in FIGS. 2 and 3, the second head module 30B is inserted in a set of insertion grooves 46 that is adjacent, in the −Y direction, to the set of insertion grooves 46 in which the manifold 52 of the first head module 30A is inserted and, in this state, inserted in the attachment opening 44. In this case, the second head module 30B is held on the base member 38 with the head chip 51 thereof facing the head chip 51 of the first head module 30A in the Y direction. The inflow port 76 of the first head module 30A and the inflow port 76 of the second head module 30B are arranged at the same position in the X direction.

An array pitch of the ejection channels 57 on the head chip 51 of the second head module 30B is shifted by a half pitch from an array pitch of the ejection channels 57 on the head chip 51 of the first head module 30A (a staggered form). Accordingly, the head chip 51 of the first head module 30A and the head chip 51 of the second head module 30B eject one color of ink in corporation with each other to enable high-density recording of characters or images recorded on the recording medium P. In the first head module 30A and the second head module 30B, the array pitch of the ejection channels 57 of the head chip 51 can be appropriately changed.

As illustrated in FIG. 2, the third head module 30C and the fourth head module 30D are held on the base member 38 with their head chips 51 facing each other in the same manner as the first head module 30A and the second head module 30B. Each of the head modules 30A to 30D is fixed to the base member 38 through a stay (not illustrated) which is provided in a standing manner in the +Z direction from the base member 38. The inflow ports 76 of the third head module 30C and the fourth head module 30D are located at a side opposite to the inflow ports 76 of the first head module 30A and the second head module 30B in the X direction (at a +X direction end of the flow path plate 75).

(Damper)

The damper 31 is provided corresponding to each color of ink in the +Z direction with respect to the head modules 30A to 30D. That is, in the present embodiment, one damper 31 is provided for two head modules (e.g., the head modules 30A, 30B). The dampers 31 are arranged side by side in the Y direction. The dampers 31 have the same configuration except the colors of ink supplied thereto. Thus, hereinbelow, one of the dampers 31 (the damper for the head modules 30A, 30B) will be described, and description for the other damper 31 will be omitted.

The damper 31 is attached in the +Z direction with respect to the head modules 30A, 30B through a stay (not illustrated) which is fixed to the base member 38. The damper 31 includes an inlet port 100, a pressure buffer 101, and an outlet port 102. The damper 31 may be separately provided from the ink jet head 5A.

The inlet port 100 is formed in a tubular shape projecting in the +Z direction from the pressure buffer 101. The ink tube 16 (refer to FIG. 1) described above is connected to the inlet port 100. Ink inside the ink tank 15 flows into the inlet port 100 through the ink tube 16.

The pressure buffer 101 is formed in a box shape. The pressure buffer 101 stores a movable film inside thereof. The pressure buffer 101 is disposed between the ink tank 15 (FIG. 1) and the head modules 30A, 30B to absorb pressure fluctuations of ink supplied to the damper 31 through the inlet port 100.

The outlet port 102 is formed in a tubular shape projecting in the −X direction from the pressure buffer 101. Ink discharged from the pressure buffer 101 flows into the outlet port 102.

A filter unit 110 is connected to the outlet port 102. The filter unit 110 stores a filter (not illustrated) therein. The filter unit 110 removes air bubbles and foreign substances contained in ink discharged from the damper 31 by the filter. The filter unit 110 includes branch portions 111, 112 which divide ink discharged from the damper 31 into two branches. The branch portion 111 is connected to the inflow port 76 of the first head module 30A through a connection tube 113. The branch portion 112 is connected to the inflow port 76 of the second head module 30B through a connection tube 114. The filter unit 110 is fixed to the base member 38 through a stay (not illustrated). The external connection board 92 described above is disposed between the dampers 31 which are opposed to each other in the Y direction.

Figure 7:
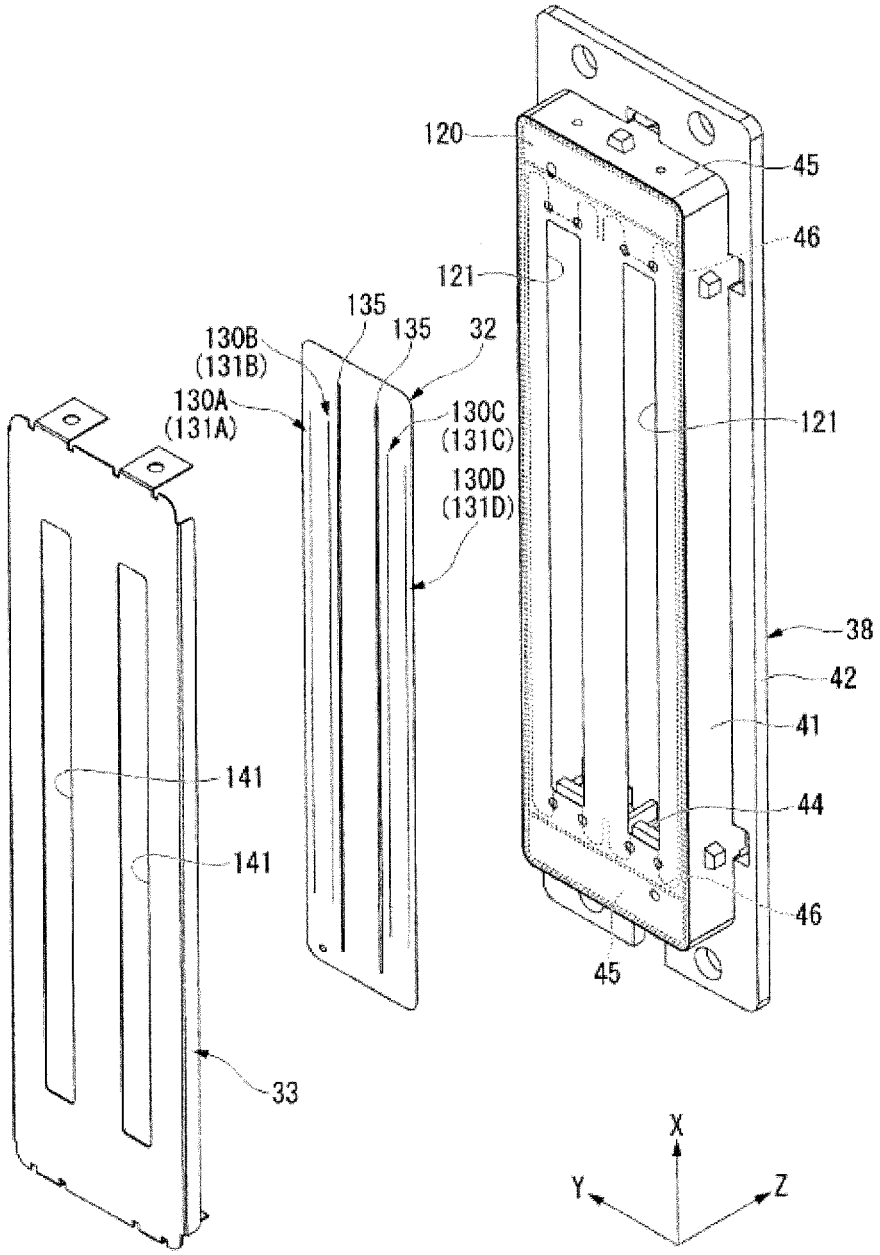
FIG. 7 is an exploded perspective view of a base member, a nozzle plate, and a nozzle guard according to the embodiment.

FIG. 7 is an exploded perspective view of the base member 38, the nozzle plate 32, and the nozzle guard 33.

As illustrated in FIG. 7, a spacer 120 is fixed to the −Z direction end face (plate placement face) of the module holding portion 41 in the above base member 38. The spacer 120 is formed of polyimide or SUS. The spacer 120 is adhered to the −Z direction end face of the module holding portion 41 using a soft adhesive. A silicone adhesive (e.g., 1211 manufactured by ThreeBond Holdings Co., Ltd) is suitably used as the soft adhesive.

The spacer 120 covers the −Z direction end face of the module holding portion 41 from the −Z direction. The spacer 120 includes a spacer opening 121. The spacer opening 121 is formed at a position that overlaps the head chip 51 of each of the head modules 30A to 30D when viewed from the Z direction and exposes the head chip 51 in the −Z direction. In the present embodiment, the spacer opening 121 collectively exposes the head chips 51 for each color (e.g., the head chips 51 of the first head modules 30A and the second head module 30B). The spacer opening 121 may collectively expose the head chips 51 of the respective head modules 30A to 30D, or may individually expose each of the head chips 51.

(Nozzle Plate)

The nozzle plate 32 is formed of a resin material such as polyimide. A +Z direction end face (the face facing the base member 38) of the nozzle plate 32 is fixed to the spacer 120 and the −Z direction end faces of the head chips 51 with a hard adhesive. The hard adhesive is formed of, for example, a material that is harder in Shore hardness than the soft adhesive described above. An epoxy adhesive (e.g., 931-1T1N1 manufactured by Henkel Ablestik Japan Ltd.) is preferably used as such a material. The nozzle plate 32 may be directly adhered to the base member 38 using a soft adhesive.

As illustrated in FIGS. 2 and 7, the nozzle plate 32 collectively covers the head chips 51 of the respective head modules 30A to 30D from the −Z direction. The nozzle plate 32 includes a plurality of nozzle arrays (first to fourth nozzle arrays 130A to 130D) each of which extends in the X direction. The nozzle arrays are formed at intervals in the Y direction.

Each of the nozzle arrays (jet hole arrays) 130A to 130D is formed on the nozzle plate 32 at a position facing the head chip 51 of a corresponding one of the head modules 30A to 30D in the Z direction.

Figure 8:
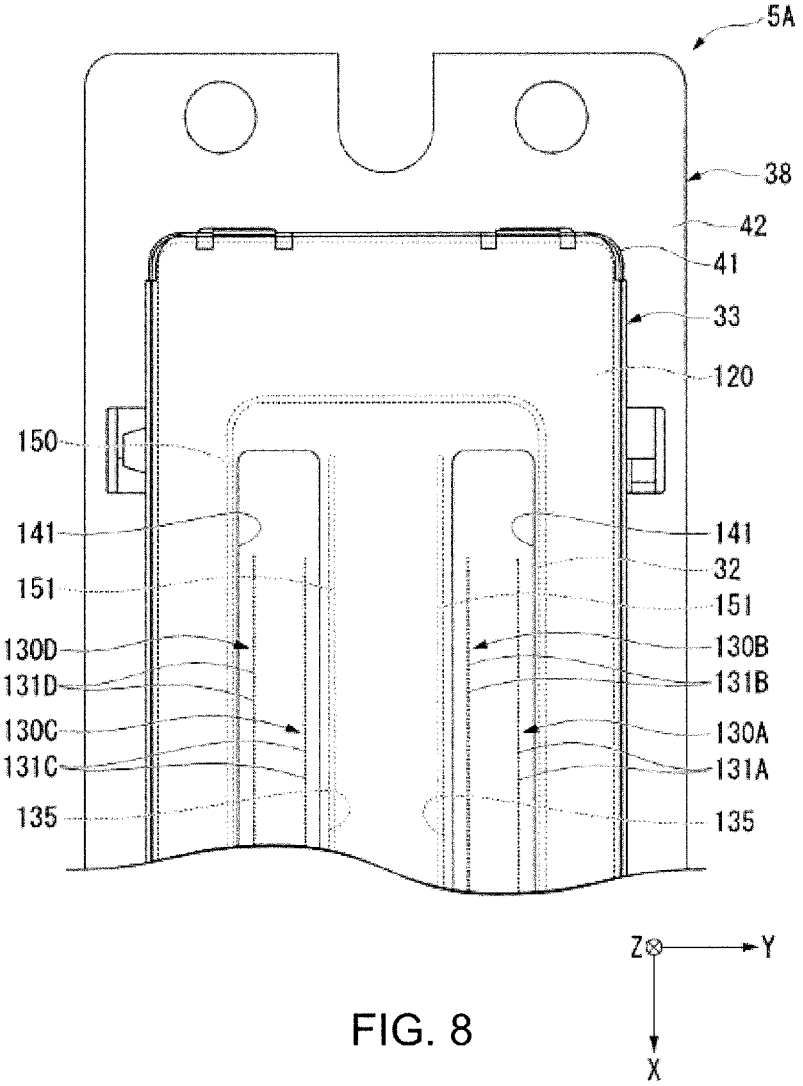
FIG. 8 is a partial bottom view of the ink jet head according to the embodiment viewed from a −Z direction.

FIG. 8 is a partial bottom view of the ink jet head 5A viewed from the −Z direction.

As illustrated in FIG. 8, the nozzle arrays 130A to 130D include nozzle holes (first to fourth nozzle holes 131A to 131D) each of which penetrates the nozzle plate 32 in the Z direction. For example, the first nozzle holes (jet holes) 131A are formed on the nozzle plate 32 at positions facing the respective ejection channels 57 of the head chip 51 in the first head module 30A in the Z direction. That is, the plurality of first nozzle holes 131A are linearly formed at intervals in the X direction to constitute the first nozzle array 130A.

Similarly to the first nozzle holes 131A, the second nozzle holes 131B, the third nozzle holes 131C, and the fourth nozzle holes 131D are formed on the nozzle plate 32 at positions facing the ejection channels 57 of the head chips 51 in the respective head modules 30B to 30D in the Z direction.

As illustrated in FIG. 7, a slit 135 which penetrates the nozzle plate 32 in the Z direction is formed in a part of the nozzle plate 32 located between the second nozzle array 130B and the third nozzle array 130C in the Y direction. In the present embodiment, two slits 135 are formed at an interval in the Y direction. The slits 135 extend parallel to the nozzle arrays 130A to 130D along the X direction. The length in the X direction of the slit 135 is longer than the nozzle arrays 130A to 130D. The length of the slit 135 can be appropriately changed to any length shorter than the length in the X direction of the nozzle plate 32. The number of slits 135 is not limited to two, and can be appropriately changed.

The material of the nozzle plate 32 is not limited to a resin material. The nozzle plate 32 may be formed of a metal material (e.g., stainless steel), or may be a laminated structure of a resin material and a metal material. Note that the nozzle plate 32 is preferably made of a material having a thermal expansion coefficient equivalent to the spacer 120. A liquid repellent treatment is applied to a −Z direction end face of the nozzle plate 32. In the present embodiment, the single nozzle plate 32 collectively covers the head modules 30A to 30D. However, the present invention is not limited to this configuration. A plurality of nozzle plates 32 may individually cover the respective head modules 30A to 30D. The liquid repellent treatment may not be applied to the nozzle plate 32.

(Nozzle Guard)

The nozzle guard 33 is formed, for example, by pressing a plate material such as stainless steel. The nozzle guard 33 covers the module holding portion 41 from the −Z direction with the nozzle plate 32 and the spacer 120 interposed therebetween.

The nozzle guard 33 includes an exposure hole 141 which is formed at a position facing the nozzle arrays 130A to 130D in the Z direction and exposes the nozzle arrays 130A to 130D to the outside. The exposure hole 141 penetrates the nozzle guard 33 in the Z direction and is formed in a slit-like shape extending in the X direction. In the present embodiment, two exposure holes 141 are formed at an interval in the Y direction corresponding to the nozzle arrays 130A, 130B ejecting the same color of ink and the nozzle arrays 130C, 130D ejecting the same color of ink. That is, one of the exposure holes 141 exposes the first nozzle array 130A and the second nozzle array 130B to the outside. The other exposure hole 141 exposes the third nozzle array 130C and the fourth nozzle array 130D to the outside.

As illustrated in FIG. 8, the nozzle guard 33 is fixed to the spacer 120 with, for example, an adhesive. Specifically, the nozzle guard 33 is adhered to a part of the spacer 120 that is located on the outer side with respect to the nozzle plate 32 in plan view viewed from the Z direction (hereinbelow, referred to as a "first adhesion region 150"). The first adhesion region 150 is set to a frame shape surrounding the entire periphery of the nozzle plate 32. The first adhesion region 150 may be adhered to the outer peripheral edge of the nozzle plate 32 as long as it is adhered to the spacer 120 at least outside the nozzle plate 32.

Further, the nozzle guard 33 is adhered to a part of the spacer 120 that is exposed through each of the slits 135 of the nozzle plate 32 (hereinbelow, referred to as a "second adhesion region 151"). That is, the second adhesion region 151 extends parallel to the nozzle arrays 130A to 130D along the X direction. Accordingly, the second adhesion region 151 partitions between nozzle arrays of different colors in the nozzle arrays 130A to 130D (between the second nozzle array 130B and the third nozzle array 130C).

[Printer Operation Method]

Next, a method for recording information on the recording medium P using the printer 1 described above will be described.

As illustrated in FIG. 1, when the printer 1 is actuated, the grid rollers 11, 13 of the conveyance mechanisms 2, 3 rotate. Accordingly, the recording medium P is conveyed in the +X direction between the grid rollers 11, 13 and the pinch rollers 12, 14. Simultaneously, the drive motor 28 rotates the pulley 26 to cause the endless belt 27 to travel. Accordingly, the carriage 23 moves back and forth in the Y direction while being guided by the guide rails 21, 22.

During this operation, in each of the ink jet heads 5A, 5B, drive voltage is applied to the drive electrodes of the head chip 51. This produces thickness-shear deformation in the drive walls 61, which generates pressure waves in ink filled inside the ejection channels 57. The pressure waves increase the internal pressure of the ejection channels 57, so that the ink is ejected through the nozzle holes 131A to 131D. Then, the ink lands on the recording medium P. As a result, various kinds of information are recorded on the recording medium P.

In the present embodiment, for example, in the first head module 30A, the head chip 51 and the drive board 53 are supported on the manifold 52 which includes the ink flow path 71.

According to this configuration, a member which supports the head chip 51 and the drive board 53 and the ink flow path 71 are integrated to the manifold 52 which is disposed at one side in the Y direction with respect to the head chip 51. This makes it possible to downsize the first head module 30A in the Y direction (main-scanning direction) as compared to a conventional configuration in which a member which supports a head chip and a drive board is disposed at one side in the Y direction with respect to the head chip and a member which includes an ink flow path is separately disposed at the other side in the Y direction with respect to the head chip. As a result, it is possible to downsize the ink jet head 5A in the Y direction.

Heat generated in the head chip 51 and the drive board 53 is dissipated to the outside through the manifold 52. This makes it possible to enhance the heat dissipation performance of the head chip 51 and the drive board 53.

Further, since the head chip 51 and the drive board 53 are supported on the manifold 52 which includes the ink flow path 71, ink flowing through the ink flow path 71 can be heated (kept warm) using exhaust heat which is generated in the head chip 51 and the drive board 53 and transmitted to the manifold 52. As a result, it is possible to supply ink having a desired temperature (viscosity) to the head chip 51 and thereby obtain an excellent printing characteristic.

In addition, in the present embodiment, the head modules 30A to 30D can be downsized in the Y direction. Thus, the manifold 52 can be provided in each of the head chips 51. As a result, it is possible to enhance the heat dissipation performance of each of the head chips 51 as compared to a configuration in which a plurality of head chips 51 are mounted on each of the head modules 30A to 30D in order to achieve high-density recording.

Further, since the head modules 30A to 30D can be downsized in the Y direction, it is possible to provide the small ink jet heads 5A, 5B.

In the present embodiment, the damper 31 is disposed in the +Z direction with respect to the manifold 52. Thus, it is possible to downsize the ink jet head 5A in the Y direction as compared to a configuration in which the damper 31 and the manifold 52 are disposed side by side in the Y direction.

In the present embodiment, the ink flow path 71 extends in a meandering manner. Thus, exhaust heat from the head chip 51 and the drive board 53 can be effectively transmitted to ink inside the ink flow path 71. As a result, it possible to supply ink having a desired temperature (viscosity) to the head chip 51 and thereby obtain an excellent printing characteristic.

In the present embodiment, the heater 85 is disposed on the face facing the +Y direction (the face opposite to the face supporting the drive board 53) of the manifold 52.

According to this configuration, ink flowing through the ink flow path 71 can be heated also by the heater 85 in addition to the exhaust heat from the head chip 51 and the drive board 53. Thus, it is possible to reliably supply ink having a desired temperature to the head chip 51.

In the present embodiment, the insulating sheet 86 is interposed between the head chip 51 and the manifold 52. Thus, a stray capacitance between the head chip 51 and the manifold 52 can be reduced. As a result, it is possible to reduce electrical noises generated when the head chip 51 is driven and enhance the operation reliability of the ink jet head 5A.

Further, the use of a material having ink resistance such as polyimide as the insulating sheet 86 makes it possible to reduce elution of the insulating sheet 86 caused by ink and reduce ejection failures.

Further, the use of a soft material such as polyimide as the insulating sheet 86 makes it possible to relax a stress that acts on the head chip 51 and the manifold 52 due to a difference in thermal expansion coefficient between the head chip 51 and the manifold 52. As a result, for example, it is possible to reduce cracking of the head chip 51 and come-off of the head chip 51 from the manifold 52.

In the present embodiment, the nozzle plate 32 which includes the nozzle arrays 130A to 130D corresponding to the respective head modules 30A to 30D is disposed on the −Z direction end face of the base member 38.

This configuration makes it possible to improve the position accuracy of the nozzle holes 131A to 131D as compared to a configuration in which the nozzle plate 32 is attached to each of the head modules 30A to 30D.

In the present embodiment, the spacer 120 is interposed between the nozzle plate 32 and the base member 38. Thus, it is possible to relax a stress that acts on the nozzle plate 32 and the base member 38 due to a difference in thermal expansion coefficient between the nozzle plate 32 and the base member 38.

Further, in the present embodiment, the spacer 120 is adhered to the base member 38 with the soft adhesive. Thus, it is possible to reliably relax a stress that acts on the spacer 120 and the base member 38 due to a difference in thermal expansion coefficient between the spacer 120 and the base member 38.

As a result, it is possible to reduce come-off of nozzle plate 32 from the head chip 51.

In the present embodiment, the first adhesion region 150 between the nozzle guard 33 and the spacer 120 surrounds the periphery of the nozzle plate 32.

According to this configuration, when ink adhered to the −Z direction end face of the nozzle plate 32 or the nozzle guard 33 tries to enter the inside of the ink jet head 5A through a gap between the nozzle plate 32 and the nozzle guard 33, it is possible to dam up the ink with the first adhesion region 150. As a result, it is possible to prevent ink from entering the inside of the ink jet head 5A.

In the present embodiment, the second adhesion region 151 between the nozzle guard 33 and the spacer 120 is disposed between the nozzle arrays 130B, 130C which eject different colors of ink in the nozzle arrays 130A to 130D.

According to this configuration, the different colors of ink adhered onto the −Z direction end face of the nozzle plate 32 are blocked by the second adhesion region 151. This makes is possible to reduce leakage of a mixture of the different colors of ink to the outside of the ink jet head 5A.

In the present embodiment, the first biasing member and the second biasing members 70 which bias the base member 38 and the head modules 30A to 30D to one side in the X direction and the Y direction are interposed between the base member 38 and the head modules 30A to 30D.

According to this configuration, the head modules 30A to 30D are held on the base member 38 in a state pressed to the one side in the X direction and the Y direction. Thus, it is possible to position the head modules 30A to 30D with respect to the base member 38 with high accuracy. As a result, it is possible to improve assemblability when the head modules 30A to 30D are fixed to the base member 38 through the stays thereafter.

In the present embodiment, the temperature sensor 94 is disposed on the back face of the actuator plate 55. Thus, it is possible to precisely detect the ink temperature in the ejection channels 57 as compared to a case in which the temperature sensor 94 is disposed at a position away from the actuator plate 55.

In particular, in the present embodiment, the heat transfer plate 65 is disposed between the temperature sensor 94 and the actuator plate 55 so as to cover the entire channels 57, 58. Thus, it is possible to detect an average ink temperature in all the ejection channels 57.

In the present embodiment, the flow path member 72 and the flow path cover 73 are stacked to form the manifold 52. This makes it possible to easily form the ink flow path 71 on the manifold 52 as compared to a configuration in which the manifold 52 is integrally formed.

In the present embodiment, the head chip 51 and the drive board 53 are supported on the flow path cover 73. Thus, the flow path member 72 can be formed of a material having a high thermal conductivity regardless of proof stress for supporting the head chip 51 and the drive board 53. In this case, since the flow path cover 73 is thinner than the flow path member 72, heat generated in the head chip 51 and the drive board 53 is easily transmitted to the flow path member 72 through the flow path cover 73. As a result, the heat generated in the head chip 51 and the drive board 53 is effectively dissipated to the outside through the manifold 52, which enhances the heat dissipation performance of the head chip 51 and the drive board 53.

The printer 1 of the present embodiment is provided with the ink jet head 5A described above. Thus, it is possible to provide the printer 1 having high reliability while achieving downsizing in the Y direction.

The technical scope of the present invention is not limited to the above embodiment, and various modifications can be added without departing from the gist of the invention.

For example, in the above embodiment, the ink jet printer 1 has been described as an example of the liquid jet apparatus. However, the liquid jet apparatus is not limited to a printer. For example, the liquid jet apparatus may be a fax machine or an on-demand printing machine.

In the above embodiment, the four head modules 30A to 30D are mounted on the base member 38. However, the present invention is not limited only to this configuration. The number of head modules mounted on the base member 38 may be on or more.

In the above embodiment, each two of the head modules eject one color of ink. However, the present invention is not limited only to this configuration. Three or more head modules may eject one color of ink, or one head module may eject one color of ink.

In the above embodiment, the edge shoot type head chip has been described. However, the present invention is not limited thereto. For example, the present invention may be applied to a side shoot type head chip which ejects ink from a central part in an extending direction of an ejection channel.

Further, the present invention may be applied to a roof shoot type head chip in which the direction of pressure applied to ink and an ejection direction of ink droplets are equal.

In the above embodiment, the head chip 51 and the drive board 53 are supported on the face facing the −Y direction of the flow path cover 73. However, the present invention is not limited only to this configuration. The head chip 51 and the drive board 53 may be supported on any face facing the Y direction in the manifold 52. For example, when the face facing the −Y direction in the manifold 52 is included in the flow path member 72 and the flow path cover 73, either the head chip 51 or the drive board 53 may be supported on the flow path member 72, and the other one may be supported on the flow path cover 73.

In addition to the above, an element in the above embodiment can be appropriately replaced with a known element, or the above modifications may be appropriately combined without departing from the gist of the invention.

What is claimed is:

1. A liquid jet head comprising:

a jet hole plate including a jet hole array, the jet hole array including a plurality of jet holes each extending in a first direction, the jet holes side by side in a second direction perpendicular to the first direction;

a head chip at one side in the first direction with respect to the jet hole plate and including channels communicating with the respective jet holes;

a manifold at one side in a third direction perpendicular to the first direction and the second direction with respect to the head chip, the manifold configured to support the head chip by a first face facing the third direction and including a liquid flow path communicating with the channels; and a drive board supported on the first face of the manifold and electrically connected to the head chip.

2. The liquid jet head according to claim 1, further comprising a damper configured to absorb pressure fluctuations of liquid supplied to the liquid flow path, the damper at a side opposite to the jet hole plate in the first direction with respect to the manifold and connected to the liquid flow path.

3. The liquid jet head according to claim 1, wherein the head chip, the manifold, and the drive board constitute a head module, and the liquid jet head further comprises a plurality of the head modules side by side in the third direction on a base member.

4. The liquid jet head according to claim 3, wherein the jet hole plate includes a plurality of the jet hole arrays corresponding to the head chips of the head modules, and on a plate placement face of the base member, the plate placement face facing a second side in the first direction.

5. The liquid jet head according to claim 4, further comprising a spacer interposed between the plate placement face of the base member and a face of the jet hole plate, the face facing the plate placement face of the base member in the first direction.

6. The liquid jet head according to claim 5, wherein the spacer is adhered to the base member with a soft adhesive, and the jet hole plate is adhered to the spacer with a hard adhesive formed of a material harder than the soft adhesive.

7. The liquid jet head according to claim 3, wherein the base member includes an attachment opening that penetrates the base member in the first direction and inserts the head module therein, and the liquid jet head further comprises a biasing member configured to bias the head module and the base member in at least either the second direction or the third direction, the biasing member interposed between the head module and the base member.

8. The liquid jet head according to claim 1, wherein the manifold includes a first flow path plate and a second flow path plate stacked in the third direction, and the liquid flow path is defined between the first flow path plate and the second flow path plate.

9. The liquid jet head according to claim 8, wherein the first flow path plate is formed of a material having a higher thermal conductivity than the second flow path plate and thicker than the second flow path plate in the third direction, and a face facing the second side in the third direction of the second flow path plate constitutes the first face that supports the head chip and the drive board.

10. A liquid jet apparatus comprising the liquid jet head according to claim 1.

* * * * *